US005884347A

United States Patent [19]

Yurchision et al.

[11] Patent Number: 5,884,347

[45] Date of Patent: Mar. 23, 1999

[54] SUPPORT SYSTEM FOR VESSELS SUCH AS SWIMMING POOLS

[75] Inventors: Peter P. Yurchision, Shavertown, Pa.; Gérard Marbach, Cernay, France

[73] Assignee: Muskin Leisure Products, Inc., Wilkes-Barre, Pa.

[21] Appl. No.: 858,637

[22] Filed: May 19, 1997

[51] Int. Cl.[6] ..... E04H 4/00; E04H 4/04

[52] U.S. Cl. ..... 4/506; 52/169.7; 4/488

[58] Field of Search ..... 4/506; 52/169.7; 472/92, 96; 256/25, 30, 31

[56] References Cited

U.S. PATENT DOCUMENTS

| | | | |
|---|---|---|---|
| 3,536,195 | 10/1970 | Oden | 210/331 |
| 3,562,822 | 2/1971 | Wall | 4/506 |
| 3,745,593 | 7/1973 | Wall | 4/506 |
| 4,182,087 | 1/1980 | Schall et al. | 407/42 |
| 4,413,361 | 11/1983 | Wolf et al. | 4/506 |
| 4,735,714 | 4/1988 | Schall | 4/512 |

FOREIGN PATENT DOCUMENTS

| | | | |
|---|---|---|---|
| 1434861 | 2/1969 | Germany | 4/506 |
| 2131989 | 1/1973 | Germany | 4/506 |

OTHER PUBLICATIONS

English translation of German Patent No. 1434861, Sep. 1, 1998.

*Primary Examiner*—Robert M. Fetsuga
*Assistant Examiner*—Tuan N. Nguyen
*Attorney, Agent, or Firm*—Dean W. Russell; Kilpatrick Stockton LLP

[57] ABSTRACT

Support systems for vessels such as above-ground swimming pools are disclosed. Each system may include one or more buttresses adapted to support substantially the entire vertical height of the side wall or each of a series of side walls of the pool. The buttresses, which flare along their lengths, closely match the support they provide each side wall to the outward water pressure present along its height for enhanced reliability. The diminished space required for installation of the disclosed buttresses reduces the surface area required for their associated pool.

7 Claims, 2 Drawing Sheets

SUPPORT SYSTEM FOR VESSELS SUCH AS SWIMMING POOLS

FIELD OF THE INVENTION

This invention relates to vessels such as swimming pools and more particularly to support systems having buttresses for walls of above-ground swimming pools.

BACKGROUND OF THE INVENTION

The popularity of swimming pools, particularly in residential areas, continues to increase. This increased popularity is based at least in part on the availability of aesthetically appealing above-ground pools, whose durability permits cost-effective purchasing by consumers. Above-ground pools additionally are particularly useful in areas where substantial excavation is either impermissible or undesirable. In densely-populated regions, for example, residential lawns may not be sufficiently large to accommodate the space required for in-ground pools. Moreover, in some cases they may be inadequate to accommodate the equipment necessary to excavate in-ground pools, even if space for such pools exists. Alternatively, above-ground pools may be preferable because of the decreased time typically needed for installation (and, if necessary, removal) or the lesser maintenance requirements and costs often associated with them.

Many substantially-permanent above-ground pools are generally either circular or oval in shape, with each type comprising multiple vertical walls and a frame. Because of their strength, galvanized steel or other compositions are usually chosen as materials from which the walls are made. Nonetheless, water pressure present at and near the bottoms of filled pools often requires the walls of above-ground pools to be braced for reliable performance. This bracing requirement is particularly pertinent in connection with oval pools, whose elongated side walls are especially vulnerable to collapse from the outward pressure exerted by the water contained therein.

As a consequence of this vulnerability, existing oval above-ground pools are constructed with braces supporting the lower sections of their side walls. Each brace includes three pieces, denominated an "upright" portion, an "angled" portion, and a "connecting" portion. FIG. 1 illustrates such braces 10 of above-ground pool 14, whose generally oval shape requires use of multiple vertical side walls 18. As shown in FIG. 1, upright portion 22 extends upward from bottom 26 of side wall 18, with connecting portion 28 being either at ground level or buried underground. An end of each of upright portion 22 and angled portion 30 connects to a respective end of connecting portion 28, while the other end 34 of angled portion 30 attaches to upright portion 22. The resulting structure resembles the outline of a right triangle, with angled portion 30 constituting the hypotenuse.

FIG. 1 details the protruding nature of braces 10. Such braces 10 frequently extend outward several feet from side walls 18 on both sides of pool 14, increasing the surface area of the lawn required for installing the pool. This increased surface area can cause difficulties in installing pools in areas subject to covenants or zoning regulations, as insufficient land may remain post-installation to meet setback and other legal or contractual requirements. Braces 10 may also inhibit lawn maintenance adjacent pool 14 and, to some, may detract from the aesthetic appeal of the pool itself. The three-piece structure of each brace 10 additionally increases its associated manufacturing and installing cost, while supporting less than the entire vertical height of a side wall 18.

SUMMARY OF THE INVENTION

The present invention, by contrast, provides a support system intended to resolve these issues. Particularly suited for vessels such as elongated above-ground pools, the support system includes a set of, typically, one-piece buttresses adapted to support the entire vertical height of one or each of a series of side walls. The flared design of the buttress, furthermore, matches the support it provides the side wall to the outward water pressure present along its height for enhanced reliability, permitting use of fewer buttresses than the number of existing braces that would otherwise be necessary. The one-piece design of the buttress further eliminates some of the manufacturing and installation costs associated with existing braces, while its sleek appearance is more likely to please discerning observers.

The diminished footprint of the innovative buttress additionally reduces the surface area required for its corresponding pool. Setback and similar requirements thus pose fewer problems than with existing pools, permitting pools incorporating the present invention to be located in smaller (especially narrower) lawns. Consequently, more residential customers in densely-populated areas are able to situate these pools in the lawn space available to them, increasing the market for the pools beyond that existing today. Abolishing the open areas between the angled portions of current braces and the ground additionally avoids many of the difficulties associated with providing lawn care in those areas.

In some embodiments of the invention, each buttress is a unitary structure whose height approximates that of the side wall or walls of its associated pool. At least one surface of the buttress contacts the side wall along substantially its entire height, supporting the height of the wall continuously against the outward pressure exerted when the pool is filled with water. Because the buttress defined by these embodiments flares along its height it assumes, in side elevational view, the general form of a truncated, solid triangle. Embodiments of the buttress further comprise notched sections to retain the bottom rim of the pool—and therefore help retain the side walls—in place.

Additionally included in some support systems of the present invention may be elongated cross-members spanning the width of the pool. Often called "omegas" because of their cross-sectional appearance, the cross-members, when present, are buried so that only their upper surfaces are above the ground. Buttresses on each side of the pool may be bolted or otherwise attached to the upper surfaces to retain them in position relative to the ground. Protruding from the upper surface of a cross-member adjacent its ends are one or more tabs, which in use fit into slots in the bottom rim of the pool to maintain its position. The buttresses, side walls, bottom rim, and cross-members thus can interact to preserve the position and structure of the pool relative to the ground. Alternatively, the buttresses may extend below ground level and be bolted, interlocked, or otherwise connected or fitted to the cross-members.

It is therefore an object of the present invention to provide a system for supporting a vessel designed to be filled with water or similar fluid.

It is also an object of the present invention to provide a system including one or more buttresses for supporting the side wall or walls of an above-ground swimming pool.

It is a further object of the present invention to provide a system in which a buttress supports a wall of a pool substantially continuously along the height of the wall.

It is another object of the present invention to provide a system for supporting pool walls in which the supporting structures extend only minimally beyond the exteriors of the walls.

It is an additional object of the present invention to provide a system, including one or more buttresses, for supporting a vessel such as an above-ground pool, in which the buttresses comprise notched sections to retain the bottom rim of the pool in position.

It is yet another object of the present invention to provide a system for supporting an above-ground swimming pool in which buttresses, side walls, the bottom rim, and cross-members interact to maintain the position and structure of the pool relative to the ground.

Other objects, features, and advantages of the present invention will be apparent with reference to the drawings and remainder of the text of this application.

DETAILED DESCRIPTION

Figure 1:
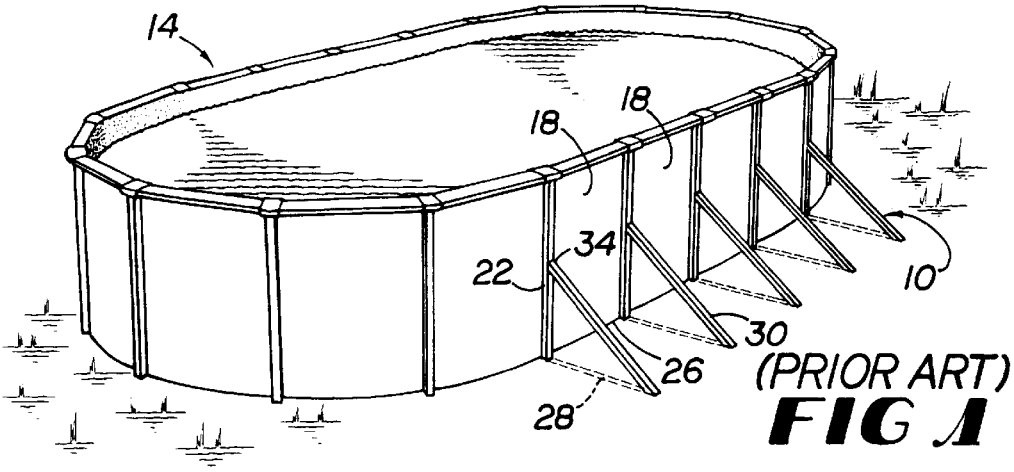
(PRIOR ART) FIG 1
FIG. 1 is a perspective view of an oval pool having an existing set of braces.
Figure 2:
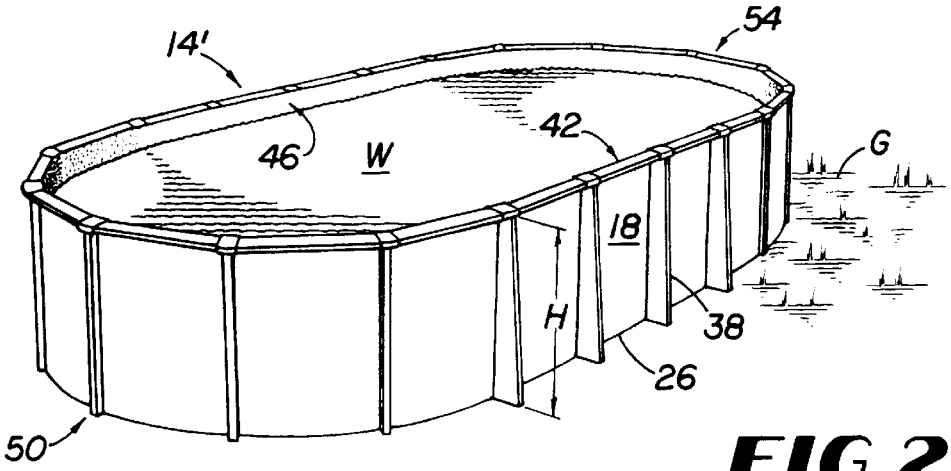
FIG. 2 is a perspective view of an oval pool utilizing a support system of the present invention.

FIGS. 2–5 and 7 illustrate buttresses 38 of the present invention. As shown in FIG. 2, buttresses 38 may be used in connection with pool 14' instead of braces 10. Doing so can adiminish significantly the surface area required for installation of pool 14', permitting pool 14' to be positioned in areas inadequate for placement of pool 14. As noted earlier, setback and similar requirements additionally pose fewer problems for pool 14' because of its smaller overall size.

Figure 3:
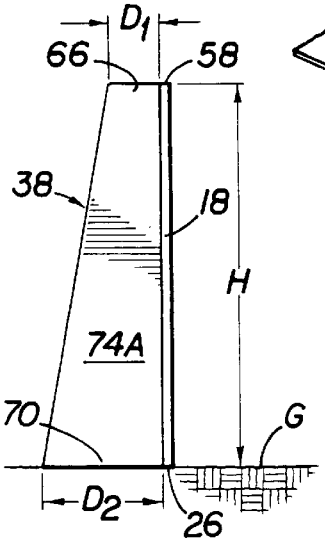
FIG. 3 is a side elevational view of a portion of the pool and of a buttress of the support system of FIG. 2.

FIGS. 2 and 3 detail typical locations of buttresses 38 in connection with pool 14'. Illustrated in FIG. 2 is a set of buttresses 38 spaced along side 42 of (generally) oval pool 14'. Although not shown in FIG. 2, a similar set of buttresses 38 may be spaced along opposite side 46 of pool 14'. Because pool 14' is oval, sides 42 and 46 are elongated relative to ends 50 and 54 and subject to greater stresses caused by the pressure of water W within the pool 14'.

This pressure within pool 14' additionally is greatest at bottom 26 of side wall 18 (adjacent ground G) and decreases toward the corresponding top 58 of the wall 18. To support the entirety of height H of side wall 18, the above-ground height of buttresses 38 may be substantially similar or identical to height H and, as shown in FIG. 3, most or all of their surfaces 62A and 62B (see FIGS. 4 and 7) may contact the side wall 18. To match more closely the support provided side wall 18 to the pressure of water W as a function of height H, buttresses 38 additionally may be flared in depth as illustrated in FIGS. 2 and 3. Such flaring results in buttress 38 having its minimum depth $D_1$ at its top 66 and its maximum depth $D_2$ at its bottom 70 (also adjacent ground G), with the depth increasing substantially continuously between top 66 and bottom 70. Buttress 38 thus resembles, in the side elevational view shown in FIG. 3, a right triangle.

Figure 4:
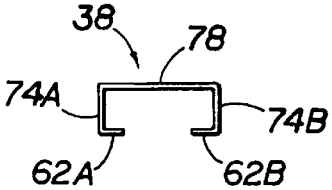
FIG. 4 is a top plan view of the buttress of FIG. 3.

Unlike brace 10, however, buttress 38 of FIG. 3 has solid sides 74A and 74B, a solid face 78, and is truncated at top 66. Surfaces 62A and 62B, moreover, function as flanges of buttress 38. The result is a unitary structure for buttress 38 that both provides greater and more uniform and continuous support for side wall 18 and has a sleeker profile than braces 10. Furthermore, for some embodiments of buttress 38, maximum depth $D_2$ does not exceed ten inches, an amount significantly less than the distance (typically thirty-six inches) from pool 14 that braces 10 protrude. Other dimensions of an exemplary buttress 38 include height between approximately forty-two and sixty inches, width of approximately four inches, and a minimum depth $D_1$ of approximately two to four inches. Buttress 38 is usually made of metal such as galvanized steel but may be manufactured of other materials when necessary or appropriate. The face 78, sides 74A and 74B, and surfaces 62A and 62B of buttress 38 additionally need not be integrally formed, although so forming them may avoid reducing the strength of the overall structure. Surfaces 62A and 62B also need not necessarily be formed at substantially right angles to respective sides 74A and 74B as shown in FIG. 4.

Figure 6:
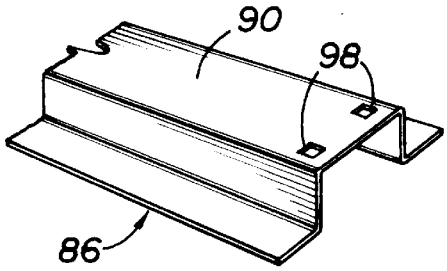
FIG. 6 is a perspective view of a portion of the cross-member of FIG. 5.
Figure 5:
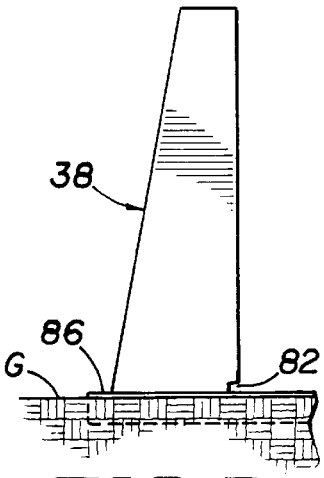
FIG. 5 is a side elevational view of the buttress of FIG. 3 together with a surface of a cross-member of the support system of the present invention.
Figure 7:
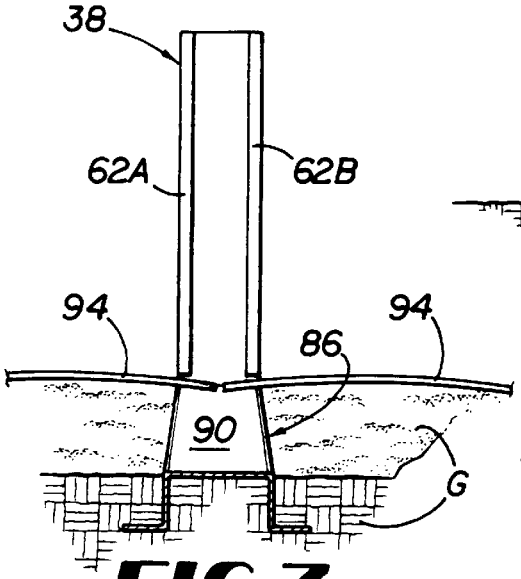
FIG. 7is a (nominally) front elevational view of the buttress of FIG.. 3 together with portions of the cross-inember of FIG. 5 and the bottom rim of the pool of FIG. 2.

FIG. 5 illustrates notched section 82 of buttress 38. In use, buttress 38 may be connected (by bolts or other suitable means) to a cross-member 86 spanning the width of pool 14'. Such a cross-member 86 is shown in FIG. 6 and is buried in ground G so that only upper surface 90 is visible, and it is to this surface 90 that buttress 38 connects. Attaching buttress 38 to cross-member 86 in this manner thus retains the buttress 38 in position relative to ground G. Once buttress 38 is positioned, rim 94 (see FIG. 7) may be fitted into section 82 to assist in fixing its placement relative to the ground G. Slots of rim 94 additionally may receive tabs 98 protruding from upper surface 90 of cross-member 86 to complete its positioning. Side wall 18 may then be fitted into rim 94 in conventional fashion to retain it in place. Those skilled in the art will thus recognize that buttresses 38, side wall 18, rim 94, and cross-members 86 of the present invention may be designed if desired to interact appropriately to preserve the position and structure of pool 14' relative to the ground G.

Figure 8:
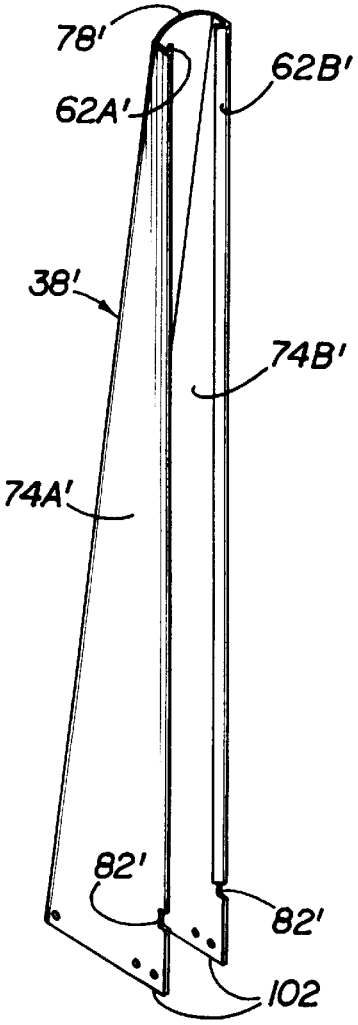
FIG. 8 is a perspective view of an alternative buttress of the present invention.

Shown in FIG. 8 is an alternative buttress 38'. Unlike corresponding components of buttress 38, face 78' of buttress 38' is curved, and surfaces 62A' and 62B' are formed at acute angles to respective sides 74A' and 74B'. Buttress 38' additionally extends beyond notched section 82' to terminate at lower edge 102, which in use is buried underground.

Figure 9A:
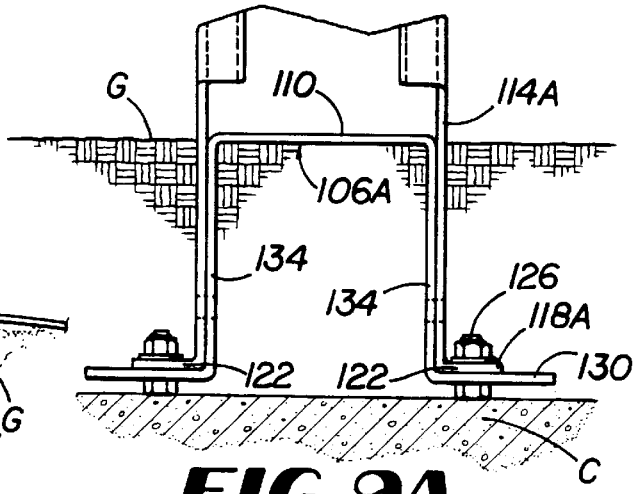
FIGS. 9A–C are (nominally) front elevational views of yet alternative buttresses and cross-members for use as support systems of the present invention.
Figure 9B:
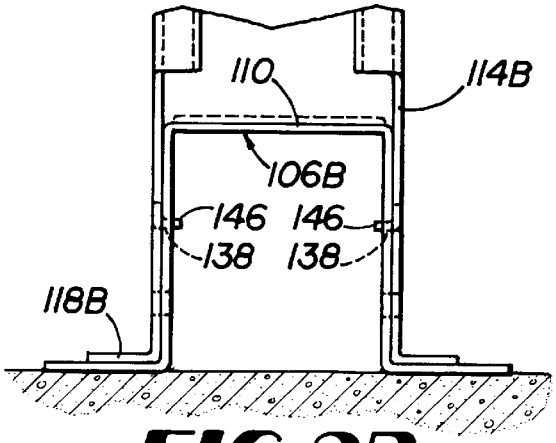
Figure 9C:
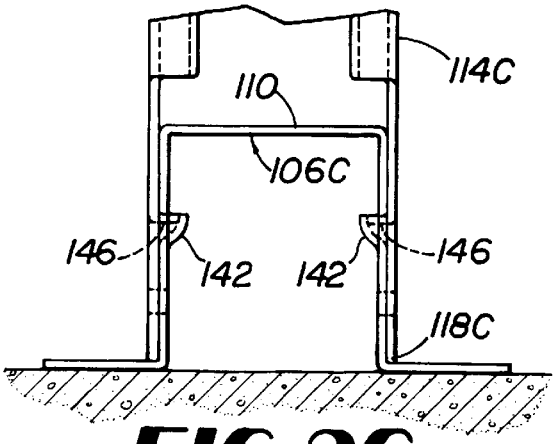

FIGS. 9A–C detail alternate cross-members 106A–C. Like upper surface 90 of cross-member 86, upper surfaces 110 of cross-members 106A–C are at or near the level of ground G. Similar to buttress 38', furthermore, buttresses 114A–C extend so that lower edges 118A–C are buried underground. In the buttress 114A of FIG. 9A, lower edges 118A are bent to form flanges 122, which include apertures in which bolts 126 or other fasteners may be placed. Horizontal sections 130 additionally include apertures for receiving bolts 126, thereby permitting buttress 114A to be fastened to cross-member 106A. By connecting buttress 114A to horizontal sections 130 rather than vertical sections 134 of cross-member 106A, bolts 126 are subjected to reduced shear stresses. Optionally excavating ground G to pour a concrete or other base C beneath horizontal section 130 may enhance the ability of buttress 114A to support a pool.

Cross-members 106B and 106C instead may include slots 138 or recessed segments 142 for receiving pins or tabs 146 of buttresses 114B or 114C. Such slots 138 or recesses formed by segments 142 effectively retain buttresses 114B or 114C in position relative to respective cross-members 106B or 106C by engaging, or interlocking with, tabs 146 below ground G. Although lower edge 118B is flanged and lower edge 118C is not, such edges 118B–C may be interchanged as necessary or desired. In any case, the result is a relatively secure positioning of a buttress 38', 114A, 114B, or 114C vis-a-vis a cross-member 106A, 106B, or 106C by connecting them underground.

The foregoing is provided for purposes of illustrating, explaining, and describing embodiments of the present invention. Modifications and adaptations to these embodiments will be apparent to those skilled in the art and may be made without departing from the scope or spirit of the invention.

What is claimed is:

1. A system for maintaining in position a wall of an above-ground swimming pool designed to contain water, comprising:

a. means, adapted to contact the wall substantially continuously along its height and comprising a buttress having (i) a top, (ii) a bottom, (iii) a face, (iv) a plurality of sides, each connected to the face, (v) at least one surface connected to one of the sides and for contacting the wall, (vi) a notch in the surface, and (vii) a depth which increases substantially continuously from top to bottom, for supporting the wall against the pressure of water contained within the pool;

b. a cross-member spanning a width of the pool and adapted to be (i) connected to the buttress; and c. a rim received by the notch and into which the wall is fitted in use.

2. A system according to claim 1 in which the buttress (i) is of height at least approximately equal to the height of the wall and which, (ii) in use, protrudes no more than approximately ten inches from the wall.

3. A system according to claim 1 in which the face, plurality of sides and surface of the buttress are integrally formed in a unitary structure.

4. A system according to claim 1 in which the cross-member has an upper surface from which a tab protrudes.

5. A system according to claim 1 in which the supporting means contains a first aperture and the cross-member has a generally horizontal surface containing a second aperture, further comprising means, received by the first and second apertures, for connecting the supporting means to the cross-member underground in use.

6. A system according to claim 1 in which the supporting means comprises at least one tab and the cross-member has means for receiving the tab underground to secure the position of the supporting means relative to the cross-member in use.

7. An above-ground swimming pool designed to contain water and which defines a width, the pool comprising:

a. a plurality of cross-members, each at least partially buried in the ground and having an upper surface from which at least one tab protrudes above ground, at least one of which cross-members spans the width of the pool;

b. a rim formed at least in part by a plurality of segments, each segment adapted to receive a tab of a cross-member;

c. at least one side wall having a height and fitted into the rim so as to extend substantially vertically above the ground; and d. a plurality of buttresses, each having a top, a bottom, and a height approximating the height of the at least one side wall and comprising:

i. a surface spanning the height of the buttress and contacting at least one side wall to support the side wall against the outward pressure of water contained within the pool;

ii. at least one side connected to the surface and increasing in size from the top of the buttress to the bottom of the buttress; and iii. means, comprising a notch formed in the surface, for receiving at least one segment of the rim.

* * * * *